United States Patent [19]

Klezl

[11] 4,203,881

[45] May 20, 1980

[54] POINTING COMPOUND

[75] Inventor: Peter Klezl, Vienna, Austria

[73] Assignee: ÖMV Aktiengesellschaft, Vienna, Austria

[21] Appl. No.: 947,060

[22] Filed: Sep. 29, 1978

[30] Foreign Application Priority Data

Oct. 4, 1977 [AT] Austria ..... 7058/77

[51] Int. Cl.[2] ..... C08L 23/06; C08L 23/12; C08L 23/16; C08L 91/00

[52] U.S. Cl. ..... 260/28.5 A; 260/23 H

[58] Field of Search ..... 260/23 H, 28.5 A

[56] References Cited

U.S. PATENT DOCUMENTS

| | | | |
|---|---|---|---|
| 3,833,528 | 9/1974 | Behling et al. | 260/28.5 A S |
| 3,853,800 | 12/1974 | Haberl | 260/28.5 A X |

*Primary Examiner*—Sandra M. Person

[57] ABSTRACT

Disclosed is a pointing compound for use in making repairs particularly to road surfaces. In accordance with the invention, the pointing compound comprises a mixture of mildly air blown bitumen, at least 25% by weight of polyolefin material selected from polyethylene, polypropylene and copolymers thereof and 10 to 40% by weight of a high boiling aromatic mineral oil. The amorphous polyolefin material preferably has a molecular weight ranging from 25,000 to 30,000 and a viscosity at 170° C. of 2,000 to 5,000 cp.

7 Claims, No Drawings

POINTING COMPOUND

Among the coating and casting compounds, those of the bituminous type play a particular part, as they are used in large volume above all in road construction and therefore have to be marketed at low price. Casting compounds, in particular pointing compounds on synthetic resin basis, are comparatively expensive and therefore excluded from this use. The bitumen-scrap rubber mixtures formerly employed can no longer meet the ever rising quality requirements made of such products.

It is the object of the invention to provide a pointing compound made of inexpensive starting products at reasonable production cost and coming up to the requirements of the DIN 1966 Standard, Sheet 17-19. Standard DIN 1966, Sheet 17 deals with the provisions concerning the dimensional stability under heat of these compounds (deformation value according to Nüssel). This value, for instance according to terms of delivery valid in the German Federal Republic (provisional terms of delivery for bituminous pointing compounds; established by the research association for road construction by order of the Federal Ministry of Transportation in 1967) is not to exceed certain limits for pointing compounds and represents the ratio of diameter to height of a spheric probe after 24 hours of storage at 45° C.

Standard DIN 1966, Sheet 18 establishes the resistance of hot-castable, bituminous pointing compounds to shock and impact at low temperatures (dynamic ball-indentation test according to Hermann).

DIN 1966, Sheet 19 contains the provisions relating to ductility (expansibility) and adhesive power in the joint mode according to Rabe.

Practice has shown, however, that these requirements are rarely met in every respect by the commercially available products.

It is known that bitumen constitutes an essential component of coating and casting compounds. Mixtures of bitumen with amorphous polymerisates containing inorganic compounds as fillers are also known. But it was found in the course of extensive investigations that the ductility (expansibility) at low temperatures is noticeably impaired by the addition of inorganic fillers.

It was found that in order to produce qualitatively superior pointing compounds, it is indispensable to employ a three-component system and that omission of one of these components will cause a strong deterioration of the system. This three-component system must consist of a midly blown (air-oxidized) bitumen, a virtually amorphous polyolefin (preferably atactic polypropylene) and a high-boiling mineral oil or mineral oil product as solubilizer.

Austrian Patent Specification No. 313 574 relates to casting compounds produced from mixtures of bituminous vacuum residues and/or vacuum gas oils and amorphous polyolefins. These casting compounds have the advantage of comparatively good ductility at low temperatures, but their shock and impact strength at low temperatures is inadequate. (DIN 1966, Sheet 18).

According to the invention, these disadvantages are overcome by providing a pointing compound on the basis of bitumen-plastic material mixtures which is characterized in that it contains or consists of essentially or particularly virtually amorphous polyolefin mixed with mildly blown bitumen and a solubilizer, in particular high-boiling minerals oils, mineral oil products or mineral oil derivatives and optionally a bactericide.

Among highway construction bitumens, the standard type B 100 (Austrian Standard ÖNORM B 3610—'-'Erdölbitumen für StraBenbauzwecke"—Mineral Oil Bitumen for Highway Construction Purposes—Issue of Aug. 1, 1975), at a penetration at 25° C. of 80-130 1/10 mm and a softening point (ÖNORM C 9250, part 6) of 42°-49° C. shows the best properties at low temperatures. This must probably be attributed to structural reasons, namely, that the content in asphaltene or resin in B 100 represents an optimum in miscibility with the amorphous polyolefin (asphaltene content in B 100 about 10 percent by weight, in B 200 only 7 percent by weight; of this, soft asphaltenes in B 100 about 0.3 percent by weight, in B 200 about 1.0 percent by weight). Preferably, the pointing compound according to the invention contains a mildly blown bitumen of the type >B 70, in particular B 100.

Bitumen types which are too hard impair the ductility at low temperatures.

Less critical is the type of amorphous polyolefin employed. The pointing compounds preferably contain an essentially atactic polypropylene. Essentially amorphous polyolefins and essentially atactic polypropylene within the meaning of the invention are understood to include those polymers still having crystalline moieties. Advantageously, types of an average molecular weight of 25-30.000, approximately corresponding to a viscosity at 170° C. of 2000 to 5000 cp, a softening point according to ring and ball of 115°-125° C. and a penetration at 25° C. of 30 to 40 1/10 mm are used. Their share generally amounts to >25 percent by weight based on the total pointing compound. Generally, types of lower molecular weight have slight advantages over types of higher molecular weight. Also possible is the use of amorphous copoplymerisates of ethylene and propylene.

The preferred solubilizer is a mineral oil or mineral oil product with a large aromatic moiety, if possible over 20 percent by weight. The viscosity of the oils can range between 5°-6 E.°/20° C. (MD I) and 7°-8 E°/100° C. (MD V) and exerts only a negligible influence on the properties of the final product. Excessive amounts of oil should be avoided, as otherwise a certain "bleeding" of oil from the compound occurs. A share of 10 to 40 percent by weight based on the entire pointing compound generally suffices. The adhesive power of the pointing compound to walls is improved by the solubilizer. As a protection against bacterial attack, 0.1 to 0.5 percent by weight of phenyl-$\beta$-naphthylamine can be added to the pointing compound.

The use of the pointing compound according to the invention is not restricted to road construction. The compound can basically be employed just as well for building protection or for construction work above and below ground.

A further advantage of these pointing compounds resides in the fact that the time-consuming pre-painting, for instance for concrete pointing compounds, can be omitted, which brings about a less costly processability of the products.

If the pointing compound is used as a paint, it is either applied in a heated state in the place to be coated or is introduced into a solvent.

The production of the pointing compound is very simply effected by mixing the components at the proper weight ratio at temperatures of 150°-200° C. The mixing sequence is not critical, however, atactic p-olypropylene must not be exposed to temperatures over 150° C. for protracted periods of time, as otherwise thermal decomposition will set in. It is therefore recommendable not to delay the processing of the homogenous mixture. The mixtures are still sufficiently flowable and thus easy to process at temperatures around 120° C.

The superiority of the pointing compounds according to the invention over known pointing compounds is explained by means of the following examples.

Example 1 corresponds to the pointing compound according to the invention.

Examples 2 and 3 show that a three-component system wherein one of the components is a bitumen must be used (Examples 4 and 5).

Examples 6 and 7 demonstrate that two-component mixtures of equal viscosity do not come up to the requirements.

Example 8 corresponds to a mixture according to Austrian Patent Specification No. 313 574 and Example 9 to a mixture of the preferred components of a viscosity equal to Example 8.

Examples 10, 11 and 12 relate to three commercially available pointing compounds.

| | Composition in percent by weight | | | | | | | |
|---|---|---|---|---|---|---|---|---|
| | bitumen | APP | machine oil | joint test | deformation test | ball indentation test | V 170° C., cp | remarks |
| 1 | 30 | 45 | 25 | >5 | 1.0 | passed | 700 | |
| 2 | 40 | 60 | — | 0.1 | 1.0 | failed | — | |
| 3 | — | 64.3 | 35.7 | 2.3 | 1.0 | passed | — | |
| 4 | 30 | 45 | 25 | 3.1 | 1.1 | passed | — | VR with 22E/90° C. |
| 5 | 45 | 45 | 10 | >5 | 1.1 | failed | — | VR with 73E/90° C. |
| 6 | 79 | 21 | — | 0.3 | 1.0 | failed | 700 | |
| 7 | — | 58 | 42 | 3.5 | 1.0 | passed | 700 | |
| 8 | — | 80 | 20 | 1.6 | 1.0 | failed | 1450 | APP 20 N, MD III |
| 9 | — | 70 | 30 | 2.0 | 1.0 | passed | 1450 | |
| 10 | Commercial Product A | | | 1.6 | >5 | passed | — | |
| 11 | Commercial Product B | | | 0.9 | >5 | passed | — | |
| 12 | Commercial Product C | | | 0.1 | >5 | failed | — | |

If not otherwise indicated, the bitumen employed is B 100, the APP employed is APP 3 D and the machine oil employed is MD I.
VR = vacuum residue
APP = atactic polypropylene

What is claimed is:

1. A composition of matter useful as a pointing compound comprising a mixture of:

(a) a mildly air-blown bitumen of the >B 70 standard type;

(b) at least 25% by weight of an amorphous polyolefin selected from polypropylene, polyethylene, and copolymers of propylene and ethylene having a molecular weight in the range of from 25,000 to 30,000, having a viscosity at 170° C. of 2,000 to 5,000 cp., a ring and ball softening point of 115°–125° C. and a penetration at 25° C. of 30 to 40 1/10 mm; and (c) from 10% to 40% by weight of a high-boiling aromatic mineral oil having a viscosity in the range of 5–6 E°/20° C. (MD I) to 7–8 E°/100° C. (MD V).

2. Pointing compound according to claim 1, characterized in that it contains a bactericide.

3. Pointing compound according to claim 1, wherein the solubilizer employed has an aromatic moiety of 20 percent by weight.

4. Pointing compound according to claim 1, wherein the amorphous polyolefin employed is an essentially atactic polypropylene with an average molecular weight of 25000 to 30000.

5. Pointing compound according to claim 1, wherein the amorphous polyolefin employed is present in amounts of >25 percent by weight based on the total pointing compound.

6. Pointing compound according to claim 1, wherein the mildly blown bitumen employed is a bitumen of the standard type B 100.

7. Pointing compound according to claim 1, wherein the high-boiling mineral oil employed is a spindle oil.

* * * * *